United States Patent [19]

Skvarenina

[11] 3,939,907

[45] Feb. 24, 1976

[54] ROTARY COMPRESSOR AND CONDENSER FOR REFRIGERATING SYSTEMS

[76] Inventor: John A. Skvarenina, 2639 W. Augusta, Chicago, Ill. 60622

[22] Filed: May 21, 1974

[21] Appl. No.: 472,066

[52] U.S. Cl. ..... 165/86; 165/184; 62/499

[51] Int. Cl.[2] ..... F28D 11/00; F28F 5/00

[58] Field of Search ..... 165/183, 184, 86; 62/499

[56] References Cited

UNITED STATES PATENTS

| | | | |
|---|---|---|---|
| 2,195,259 | 3/1940 | Ramsaur | 165/184 |
| 2,805,558 | 9/1957 | Knight | 62/499 |
| 3,002,729 | 10/1961 | Welsh | 165/183 |
| 3,766,976 | 10/1973 | Gelbard | 165/183 |

*Primary Examiner*—William F. O'Dea
*Assistant Examiner*—Ronald C. Capossela
*Attorney, Agent, or Firm*—Olson, Trexler, Wolters, Bushnell & Fosse

[57] ABSTRACT

The embodiment of the invention disclosed herein is directed to a rotary compressor and/or condenser for refrigerating systems. The rotary compressor has a rotor with a passage formed therethrough to be in fluid communication with an inlet port at one end of the rotor housing and in periodic fluid communication with an outlet formed at the other end of the rotor housing. The outlet passage is formed in a valve plate which is in sliding sealing contact with the terminating end of the rotor of the compressor. A condenser may be connected to a common shaft with the compressor rotor and has a rotating member with a helical passage extending therethrough. Heat radiating fins are formed on the condenser rotor to improve heat transfer for cooling.

5 Claims, 13 Drawing Figures

ROTARY COMPRESSOR AND CONDENSER FOR REFRIGERATING SYSTEMS

BACKGROUND OF THE INVENTION

This invention relates generally to improvements in the structure of apparatus used primarily in the field of refrigeration systems, and more particularly to compressors and condensers and their combination in such refrigeration systems that provides substantial useful improvement over existing refrigerating systems now commonly used in the field of freezers, refrigerators and air conditioners. However, it will be understood that while this invention is directed particularly to refrigeration systems, the specific devices disclosed herein can be used in other allied fields such as liquid compressors and rotating radiators for automobiles and the like.

Heretofore, compressors and condensers used in refrigerating systems and other allied fields have been relatively expensive and complicated to manufacture and/or operate over a relatively long period of time when they are to be made compact and light in weight. Rotating compressor devices are known in the art and provide means for moving fluid through the rotating portion of the motor drive. However, such prior art rotating compressors are deficient in that they do not achieve a progressively increasing compression of the gas or fluid passing therethrough because the fluid passage through the rotating armature is substantially of the same cross sectional area from beginning to end, and in many instances, have the inlet and outlet at the same radial dimension from the axis of the rotating shaft. Even in prior art structures where the fluid passage through the rotating armature diverges outwardly from the inlet to the outlet, there is no additional compression of the gas other than that obtained from centrifugal force.

Furthermore, prior art condenser means generally incorporate a stationary radiator through which the heated refrigeration gas passes during the condensing operation. Heat transfer is then obtained merely by radiation of heat to the outer atmosphere.

SUMMARY OF THE INVENTION

Accordingly, it is an object of this invention to provide an improved compressor and condenser structure which can be used in a refrigeration system.

Another object of this invention is to provide an improved rotating compressor wherein the problems of prior art rotating compressors or pumps are overcome to provide improved operation.

Still another object of the present invention is to provide an improved refrigeration system which overcomes the disadvantages noted above with regard to prior art refrigeration systems of similar configuration, but which retains the advantages and attributes of similar refrigerating systems with respect to cost, ease of manufacture and freedom of maintenance problems, and which refrigeration system produces reliability in conjunction with the capabilities of present technology without substantially modifying the basic components of the system in which the rotating compressor and condenser are used.

A feature of particular commercial importance is the provision of a fluid flow passage extending through a rotating armature which is of progressively diminishing cross sectional area from the inlet to the outlet of the compressor and which diverges outwardly from inlet to outlet.

Many other objects, features and advantages of this invention will be more fully realized and understood from the following detailed description when taken in conjunction with the accompanying drawings wherein like reference numerals throughout the various views of the drawings are intended to designate similar elements or components.

DETAILED DESCRIPTION OF THE ILLUSTRATED EMBODIMENTS

Figure 1:
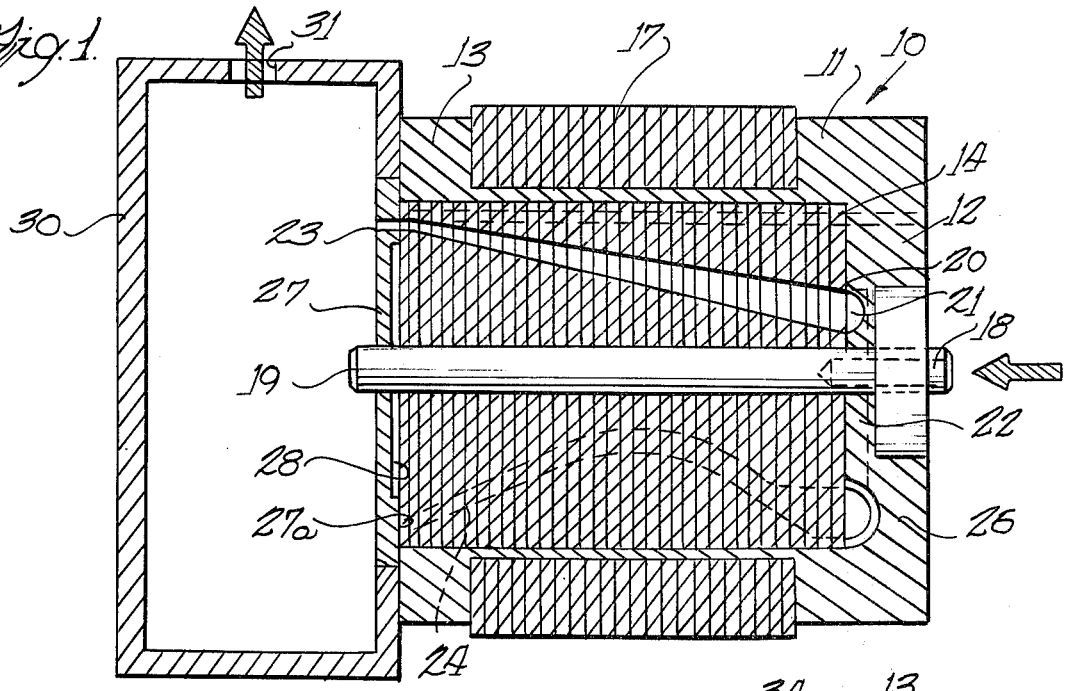
FIG. 1 is an elevational sectional view of a rotating compressor constructed in accordance with the principles of this invention.
Figure 2:
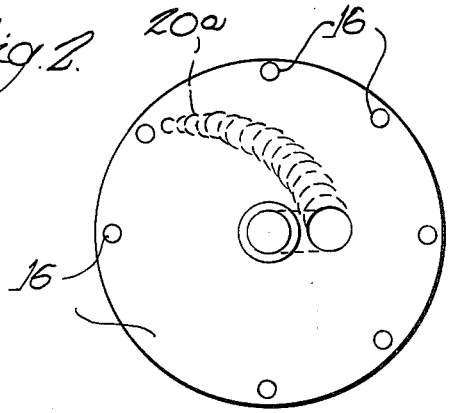
FIG. 2 is an end view of the rotating armature of the compressor of FIG. 1 illustrating the progressively diminishing area of apertures formed in a plurality of stacked together laminations which constitute the rotating armature.

Referring now to FIG. 1, there is seen a rotating compressor constructed in accordance with the principles of this invention and designated generally by reference numeral 10. The compressor 10 includes a housing member 11 having spaced apart end walls 12 and 13. The rotating compressor 10 is formed substantially of a rotor armature element 14 formed of a plurality of laminated circular discs held together by threaded shafts or welded in rods 16, as seen in FIG. 2. Drive power is obtained for the rotor element 14 by a stator structure designated generally by reference numeral 17 and positioned outwardly of the rotor and secured in place by the housing member 11. The stator 17 induces electromotive force into the rotor 14 so it functions substantially as a rotating armature of an induction motor. However, external drive power may be used if desired.

An inlet passage 18 is formed centrally of the shaft 19 of the rotor means and is in fluid communication with a fluid flow passage designated generally by reference numeral 20. In this embodiment the fluid flow passage 20 has a scoop or hooded element 21 which rotates in a recess 22 formed in the end wall 11. The fluid flow passage 20 in one instance may be straight and diverging outwardly from the inlet 18 to an outlet 23. However, in the alternative, the fluid flow passage 20 may be partially helical in configuration as illustrated in phantom lines 24. Furthermore, it will be noted that the scoop member 26 thereof may be positioned at a more radially outward position.

The outlet 23 is formed through a valve plate member 27 which has the interface 27*a* thereof in sliding contact with the endmost lamination element of the rotor means 14. The interface 27*a* may have the area reduced by forming an undercut 28 which extends from slightly inwardly of the outlet 23 to the rotating shaft 19. This reduces the area of frictional contact. Furthermore, it will be noted that the interface 27a together with the last of the laminated discs of the rotor may be coated with a permanent dry lubricating substance such as Teflon, or the like.

A gas receiving chamber 30 is secured to the end wall 13 and is provided with an outlet passage 31 so that the rotating compressor structure 10 can be connected in fluid communication with a refrigerating system. As best illustrated in FIG. 2, the end view of the rotating armature 14 shows the fluid flow passage 20*a* extending therethrough. In this instance the laminations forming the rotor armature are provided with apertures, by drilling or punching, which are of progressively diminishing cross sectional areas so that they form a substantially uniformly decreasing passage. However, it will be understood that the passage 20*a* may be formed by molding or casting of the armature structure.

Figure 3:
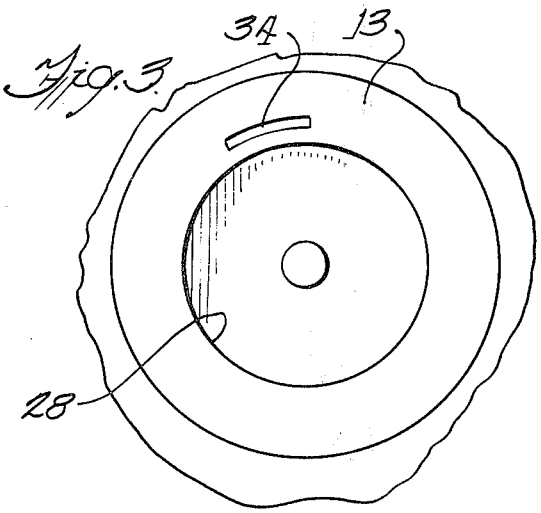
FIG. 3 is an end view of the valve plate formed at the outlet end of the compressor of FIG. 1.

FIG. 3 illustrates the undercut portion 28 in the end wall 13 and further illustrates the arcuately shaped slot 34 which forms the outlet 23. The arcuate extent of the slot 34 determines the amount of time the fluid flow passage 20 is in registry therewith during each revolution.

By providing a fluid flow passage that is progressively diminishing in cross sectional area and which is diverging radially outwardly from the inlet to the outlet, centrifugal force and a compressing action of the diminishing cross sectional area provide improved compression of the refrigerating gases.

Figure 4:
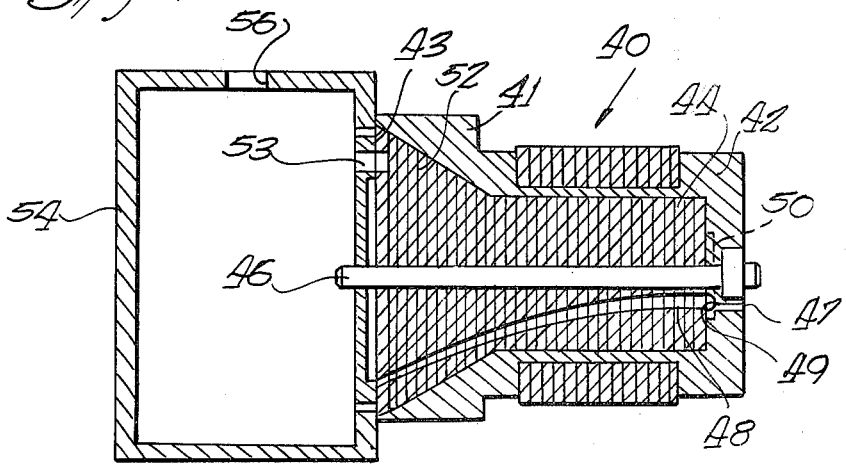
FIG. 4 is an alternate embodiment of a rotating compressor constructed in accordance with the principles of this invention.

FIG. 4 illustrates an alternate embodiment of the rotary compressor of the present invention and is designated generally by reference numeral 40. Here the compressor 40 is provided with a housing member 41 having spaced apart end walls 42 and 43 and a rotating armature member 44 secured therein for rotation about a shaft 46. In this instance an inlet passage 47 is formed displaced radially outwardly of the shaft 46 and is in fluid communication with a fluid flow passage 48 extending through the armature. Here also a scoop or hood member 49 may be provided to rotate in a recess 50 to improve forcing refrigerant gas through the fluid flow passage 48. Here again, the cross sectional area of the fluid flow passage is progressively diminishing from inlet to outlet.

To improve the centrifugal force of compression, the bell-shaped section 52 is formed at the end of the rotor 44 and thereby provides means for diverging the fluid flow passage 48 outwardly to an extent greater than the periphery of the rotor armature portion. An outlet 53 is formed in the end plate 43 and the fluid flow passage 48 is in periodic registry therewith so that compressed refrigerating gas will enter a chamber 54. The chamber 54 has an outlet 56 through which the rotating compressor 40 is connected to a refrigerating system.

Figure 5:
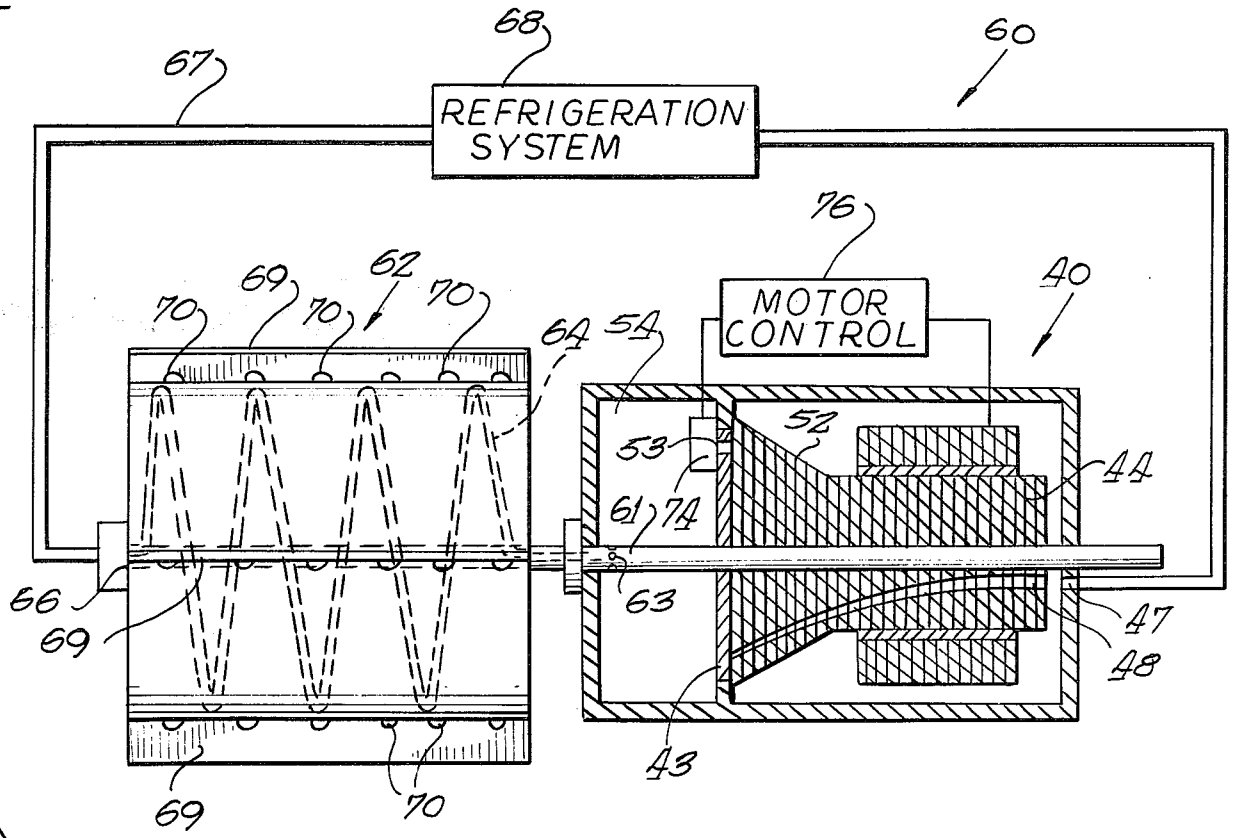
FIG. 5 illustrates a refrigeration system utilizing the rotating compressor of the present invention and further illustrates a rotating condenser for cooling refrigerating gas.

A refrigerating system utilizing the rotary compressor constructed in accordance with this invention is illustrated in FIG. 5 and is designated generally by reference numeral 60. Here the rotating compressor 40 has a common shaft 61 extending from the rotor structure 44 and through the chamber 54 so as to be in common rotation with a rotary condenser structure 62. In this instance the outlet 56 is not used and refrigerant gas passes from the chamber 54 into the rotating condenser 62 by a plurality of ports or openings 63 formed in the shaft 61. The ports 63 are in fluid communication with a helically shaped fluid passage 64 extending from one end of the rotating condenser to the other. The outlet end 66 of the rotating condenser is connected to a refrigerating line 67. which, in turn, is connected to the refrigerating coils designated by the refrigerating system 68.

Figure 6:
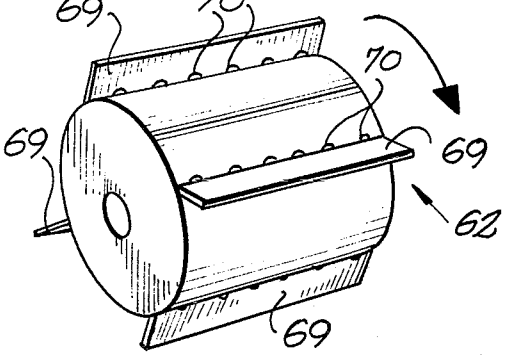
FIG. 6 is a perspective view illustrating a general configuration of the rotating condenser of FIG. 5.

A plurality of spaced apart outwardly directed heat transfer fins 69 are formed on the periphery of the rotary condenser and may include a plurality of spaced apart apertures 70 formed therein. The apertures 70 preferably are formed at the interface of the fins 69 and the surface of the rotating condenser so that air can pass therethrough and more efficiently transfer heat to the surrounding air. Furthermore, the fins 69 are inclined toward the direction of rotation, as seen in FIG. 6, so as to scoop air across the heat radiating fins and through the apertures 70.

To utilize the hot compressed gas captured in chamber 54 as a self-defrost medium, a sensing device 74 is positioned within the chamber so that registry between the fluid flow passage 48 and the outlet 53 can be sensed to effect a control signal to deenergize a motor control circuit 76. This then insures that reverse flow of the hot compressed gas is obtained from the outlet 53 through the fluid flow passage 48 and the inlet 47 back through the refrigeration system. The sensing element 74 and the motor control circuit 76 may take any conventional form and modifications thereof will not depart from the general overall concepts of the invention disclosed herein. Furthermore, the number of heat radiating fins secured to the rotating condenser may vary as desired.

Figure 7:
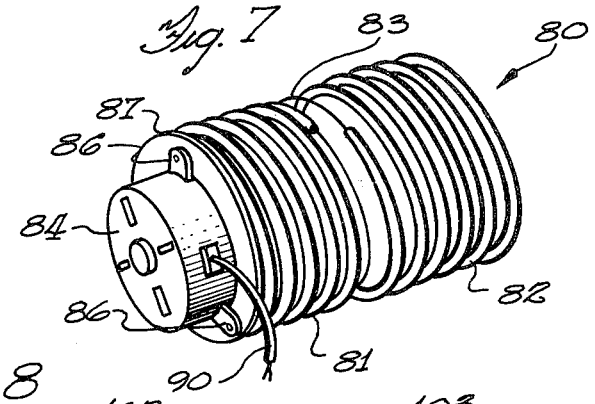
FIG. 7 is a perspective view illustrating an alternate embodiment of a refrigeration system utilizing the rotary compressor and condenser arrangement as set forth by this invention.
Figure 9:
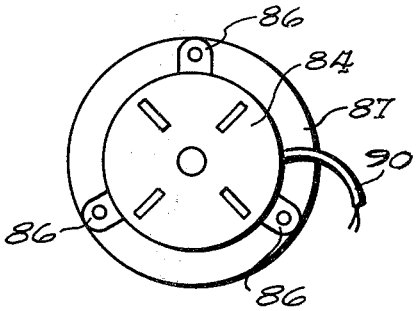
FIG. 9 is an end view illustrating the motor connection arrangement of the rotary compressor of FIG. 7.
Figure 8:
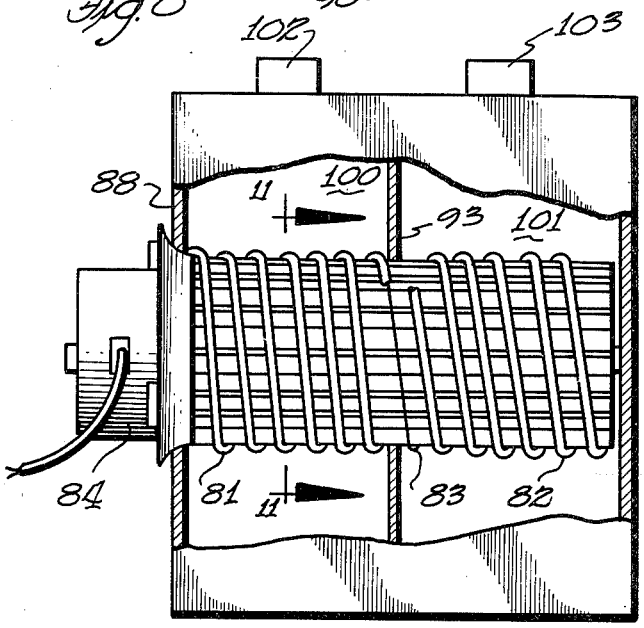
FIG. 8 is a fragmentary sectional view illustrating the rotary compressor and condenser in a housing to provide heating and cooling chambers.

Referring now to FIGS. 7, 8, 9, 10, 11, 12 and 13, there is seen an alternate embodiment of the present invention. Here the rotary compressor and condenser units have their functions interchangeable by reversing the direction of rotation of their associated drive motor. FIG. 7 illustrates the compressor and condenser units removed from their respective housing chambers and provide the basic structure for a refrigerating system and is designated generally by reference numeral 80. The refrigerating system 80 has a section of tubing 81 wound about the radially outwardly directed fins of a squirrel-cage fan unit and a second section of tubing 82 placed adjacent thereto on substantially the same axis of rotation therewith. The sections 81 and 82 are connected together by a length of capillary tube 83 which functions as the refrigerant metering orifice as is well-known in the art. The tubing sections 81 and 82 are rotated on the squirrel-cage fan configuration by an electric drive motor 84 connected thereto. The drive motor 84 has radially outwardly directed tab portions 86 secured to a mounting flange 87 which, in turn, can be secured to one end wall 88 of a housing 89, as best seen in FIG. 8. Electrical potential is applied to the motor 84 by a conductive lead 90.

Figure 12:
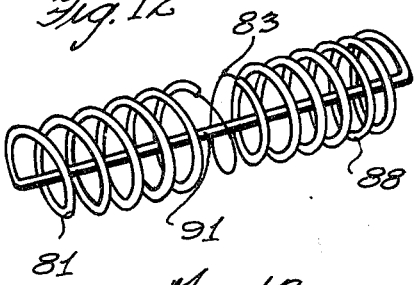
FIG. 12 is a diagrammatic representation of the rotary compressor and condenser illustrating the capillary tube joining the two sections.

In this embodiment of the invention no rotating seals are required since the entire refrigerating system is a closed loop arrangement, as best seen in FIG. 12. Here the section 81 is a fluid communication with the section 82 by means of the centrally located return line 91. While the return line 91 is illustrated as a straight length of tubing extending from end to end of the rotating compressor and condenser, it will be understood that it may be helically formed in the opposite direction so as to facilitate return flow of the refrigerant fluid within the system. The capillary tubing 83 between the sections 81 and 82 preferably is located substantially centrally of a partition wall 93 of the housing 89, thereby separating the tubing sections. Depending on the direction of rotation of the drive motor 84, one of the sections will function as a compressor while the other of the sections will function as a condenser within a refrigerating system. Therefore, the plenum chambers 100 and 101 associated with the tubing sections 81 and 82, respectively, may be provided with output openings 102 and 103, respectively, through which cold or hot air may flow, depending on the direction of rotation of the motor 84. For example, if the motor 84 rotates in one direction, section 81 may function as a cooling section while section 82 may function as the heat transfer section of a refrigerating cycle. When the motor 84 is reversed in direction, section 82 functions as the cooling section while section 81 functions as the heat transfer section.

Figure 10:
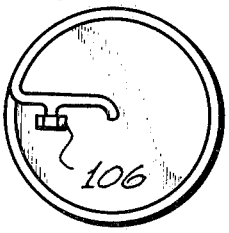
FIG. 10 is an opposite end view of that of FIG. 9.

FIG. 10 illustrates a filling connection 106 connected to one end of the helically wound tubing sections to provide means for filling the tubing with a refrigerant material such as Freon.

Figure 11:
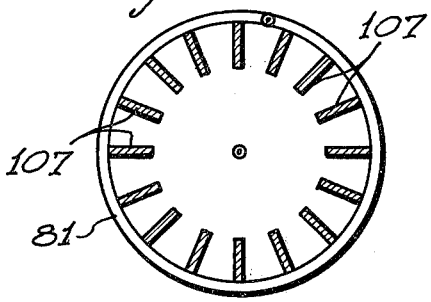
FIG. 11 is a diagrammatic representation showing the tubing for the heat exchanger and compressor wrapped about radially outwardly directed fins of a squirrel-cage-type cooling fin arrangement.

FIG. 11 illustrates more clearly a plurality of substantially equally spaced apart radially outwardly directed fins 107 which form part of a squirrel-cage configuration and upon which is wound the tubing sections 81 and 82.

Figure 13:
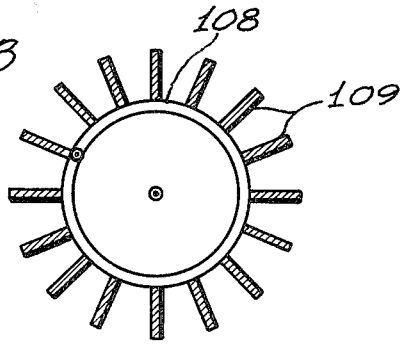
FIG. 13 is an alternate embodiment illustrating the cooling fins radially outwardly of the helically wound tubing of the rotary compressor and condenser arrangement.

FIG. 13, however, illustrates an alternate configuration and shows a helically wound tubing section 108 having a plurality of radially outwardly directed fin members 109 positioned on the outside portion thereof. The tubing section 108 may be wound upon a mandrel which is removed or may be wound upon a form member which remains an integral part of the refrigerating system unit. In each embodiment the entire refrigerating system is a closed loop arrangement requiring no rotating seals of any kind. Furthermore, the tube sections wrapped about the cooling fins tend to break up the air flow providing a turbulent condition which adds to the efficiency of cooling on the hot side and the efficiency of absorbing heat on the cold side.

While the rotating condenser arrangement in each of the embodiments is illustrated as utilized in conjunction with a refrigerating cycle, it will be understood that the condenser configuration can be utilized as a high efficiency heat exchanger for cooling fluids of any kind. For example, the rotating tubular condenser may be utilized as a heat exchanger for an automobile cooling system or the like. The tremendous advantage obtained here is simplicity of design and construction and relatively low cost. Furthermore, the requirement of having complicated movable internal parts is substantially completely eliminated.

While several embodiments of the present invention have been illustrated herein, it will be understood that further variations and modifications may be effected without departing from the spirit and scope of the novel concepts disclosed and claimed herein.

The invention is claimed as follows:

1. A heat exchanger comprising in combination: a helically wound tubing, an inlet formed at one end of said tubing, an outlet formed at the other end of said tubing, a plurality of heat radiating fins secured to the tubing and arranged along a longitudinal axis of rotation of the helically wound tubing, drive means coupled to said helically wound tubing for rotating said tubing about said longitudinal axis of rotation, whereby heated fluid passing through said helically wound tubing will be cooled during rotation thereof.

2. The heat exchanger according to claim 1 wherein said fins are located radially inwardly of said helically wound tubing.

3. The heat exchanger according to claim 1 wherein said fins are located radially outwardly of said helically wound tubing.

4. The heat exchanger according to claim 1 further including a length of tubing connected between said inlet and said outlet and passing through the helically wound tubing.

5. The heat exchanger according to claim 4 wherein said length of tubing passes through said helically wound tubing along the longitudinal axis of rotation thereof.

* * * * *